United States Patent [19]

Karlotski et al.

[11] 4,413,206

[45] Nov. 1, 1983

[54] METAL HALIDE ARC DISCHARGE LAMP HAVING ELECTROLYSIS PREVENTION MEANS

[75] Inventors: Robert J. Karlotski, Weare; Joseph S. Kulik, Jr., Allenstown; Martin E. Muzeroll, Merrimack, all of N.H.

[73] Assignee: GTE Products Corporation, Stamford, Conn.

[21] Appl. No.: 270,289

[22] Filed: Jun. 4, 1981

[51] Int. Cl.[3] ..... H01J 61/00

[52] U.S. Cl. ..... 313/601; 313/617

[58] Field of Search ..... 313/197, 198, 208, 221

[56] References Cited

U.S. PATENT DOCUMENTS

| | | | |
|---|---|---|---|
| 2,660,692 | 11/1953 | St. Louis et al. | 313/197 X |
| 2,716,198 | 8/1955 | McCallum | 313/198 X |
| 3,909,660 | 9/1975 | Sulcs et al. | 313/198 X |

*Primary Examiner*—David K. Moore
*Assistant Examiner*—Sandra L. O'Shea
*Attorney, Agent, or Firm*—Edward J. Coleman

[57] ABSTRACT

A high-pressure metal halide arc discharge lamp having an arc tube with a pair of main electrodes disposed within the tube at opposite ends and a starting electrode located adjacent one of the main electrodes. A tubular sleeve of insulating material, such as quartz, is disposed about the starting electrode, which is recessed within the sleeve but exposed through the open end thereof to the interior atmosphere of the arc tube. Since the starting electrode does not project beyond the open end of the sleeve, conduction between that electrode and the adjacent main electrode is minimized or prevented during normal lamp operation, thereby minimizing or preventing electrolysis.

6 Claims, 4 Drawing Figures

METAL HALIDE ARC DISCHARGE LAMP HAVING ELECTROLYSIS PREVENTION MEANS

BACKGROUND OF THE INVENTION

This invention relates to the field of high-pressure arc discharge lamps and is especially applicable to such lamps having a metallic halide fill. More particularly, the invention relates to lamps containing high-pressure arc tubes made of fused silica having main electrodes at both ends and a starting electrode, or probe, at one end and having the problem of electrolysis inherent to the starter electrode configuration.

High-pressure metal halide arc discharge lamps generally comprise an elongated arc tube containing an ionizable fill and having press seals at each end of the tube. Disposed within the arc tube are two main electrodes, one at each end. The electrodes are generally supported in the press seals and are usually connected to a thin molybdenum ribbon, disposed within the press seal, the purpose of the ribbon being to prevent seal failures because of thermal expansion of the lead-in wire.

In order to facilitate starting of the arc discharge, that is, ionizing of the gas fill, a starting electrode is generally disposed within the arc tube, adjacent one of the main electrodes. Such an electrode is used because an arc can be ignited between the starter electrode and its adjacent electrode at a much lower starting voltage than is required to ignite an arc between the two main electrodes. That is, placement of the starting electrode in the vicinity of one of the main electrodes reduces the gap size of the starting arc, and thereby reduces the ignition voltage requirement. Once the arc has ignited, the ionizing gas decreases the resistance between the two main electrodes and an arc is formed therebetween.

During operation of some metal halide lamps containing alkali or alkaline earth additives, electrolysis between the starting electrode and the adjacent main electrode can occur at the press seal, if there is an electric potential therebetween. The electrolysis current consists mainly of alkali ion flow and, thus, is greater in an arc tube having a fill that includes an alkali than in one that does not. However, electrolysis can always be present since the arc tube material, generally fused silica (high silica glass or quartz), usually contains minute quantities of alkali metals. Hence, because of the alkali in the fused silica or alkaline earth additives in the case of metal halide lamps, migration of the alkali ions occurs between starter and main electrode if an asymmetric potential difference occurs between those two electrodes.

At the necessarily high operating temperatures of the fused silica arc tubes, reactions between the alkali ions and fused silica and molybdenum result causing a difference in the coefficient of expansion between the newly contaminated area and the surrounding fused silica. The stress produced by the differences in expansion coefficient can cause fracture within a short period of time.

Electrolysis occurs only when the starter electrode is negative with respect to the adjacent electrode. Thus, even when the lamp is energized by an AC voltage, the starting electrode can be negative with respect to the adjacent electrode 50% of the time, unless suitable means are employed to prevent a potential thereacross.

Several prior art approaches have been employed to limit the aforementioned electrolysis problem. One such method is described in U.S. Pat. No. 3,226,597 Green, wherein a bimetal switch is used to short out the starting electrode to the adjacent main electrode when the lamp reaches normal operating temperatures. A short period of time, say, about 30 seconds was all that was normally required for the switch to heat up sufficiently and deflect and short the wires. As long as the wires were shorted, and, thus, were at the same potential, no electrolysis could occur between the two electrodes. However, electrolysis could occur during the period of time required for the switch to close.

During operation of the lamp, prolonged exposure of the switch to the heat emanating from the arc tube could cause the bimetal to take a "set" in the stressed position, with the result that the switch could require progressively longer time intervals to close. In some cases, the physical characteristics of the bimetal could be altered sufficiently to prevent closing of the switch altogether or to cause the switch to remain closed even at room temperature. In the latter case, the lamp could not normally be restarted.

Another method of solving the electrolysis problem is described in U.S. Pat. No. 3,619,711 Freese, wherein a semi-conductor diode is located such that the starter electrode cannot develop a negative potential. In many applications, semi-conductor devices have proved to be a very acceptable electrolysis preventative. However, in certain hot fixture applications, premature failure of the diodes can cause starting problems in ensuing cold weather starting situations. Semi-conductor devices are also comparatively costly.

Yet another approach is described in U.S. Pat. No. 3,906,275 Spiessens et al, wherein a metal screening element is sealed in the pinch between the lead-in conductors and does not intersect the internal surface of the envelope.

More recently, U.S. Pat. No. 3,909,660 Sulcs et al describes the use of a very short starting electrode, with the distance from the adjacent main electrode maximized within press seal constraints to essentially eliminate conduction between the starting electrode and the main electrode. The short probe is effective in most lamp types but is comparatively unreliable in metal halide lamps having improved convection currents, such as described in U.S. Pat. Nos. 3,883,766 and 3,896,326 of Fohl. The improved circulation of hot gases causes sufficient heating of the stub electrode to cause significant conduction on one-half cycle, thereby causing electrolysis and failure in a short period of time. Also, in manufacturing, it is difficult to maintain a minimal projection into the quartz arc tube without completely burying the probe and thereby eliminating the usefulnes of the starter electrode.

SUMMARY OF THE INVENTION

It is an object of the present invention to provide a high-pressure metal halide arc discharge lamp with improved means for minimizing or preventing electrolysis.

These and other objects, advantages and features, are attained, in accordance with the invention, by an arc discharge lamp comprising an arc tube containing an ionizable discharge-sustaining fill including mercury and a metal halide. First and second main electrodes are disposed within the arc tube, and a starting electrode is disposed therein adjacent the first main electrode. A sleeve of electrically insulating material is disposed about the starting electrode for minimizing or preventing conduction between that first main electrode and the starting electrode during normal lamp operation, thereby minimizing or preventing electrolysis. In a preferred embodiment, the starting electrode is recessed within the insulating sleeve, and the sleeve has an open end whereby the starting electrode is exposed to the interior atmosphere of the arc tube; it is of significant importance that the starting electrode not project beyond the open end of the sleeve.

The aforementioned construction, in accordance with the invention, resulted pursuant to our discovery that if no arc occurs between the starting and main electrodes during normal lamp operation, then no DC potential exists between these two electrodes and, therefore, electrolysis is essentially eliminated. This condition is attained by surrounding the starting electrode with an insulating sleeve, or boot, such that the starting electrode does not extend from the sleeve but is hidden inside. This configuration limits conduction between the main electrode and starting electrode so that there is substantially no conduction on either half cycle when the lamp is operating and no DC potential, therefore, there is no sodium migration and ensuing electrolysis.

In the case of mercury arc discharge lamps, it has been a known practice for many years to employ an insulating sleeve or a encapsulation about the starting probe. However, the sole purpose of this insulating sleeve was to prevent condensed mercury in the arc tube from causing a short circuit between the starting and main electrode when that end of the lamp was in the down position. Accordingly, in every instance, the starting probe extended beyond the end of the insulating sleeve in these prior art mercury lamps, a structural arrangement totally inconsistant with our teaching for preventing electrolysis. More specifically, if the old mercury lamp arrangement of a starting electrode projecting beyond an insulating sleeve were employed in the metal halide lamp, conduction between the first main electrode and the starting electrode during normal lamp operation would not be prevented or minimized and, thus, the problem of electrolysis would persist. According to our invention for limiting electrolysis, the starting electrode is encapsulated in the insulating sleeve so that it does not protrude therefrom but is buried inside the sleeve, except for a hole in the tubulation exposing the electrode to the interior atmosphere of the arc tube.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
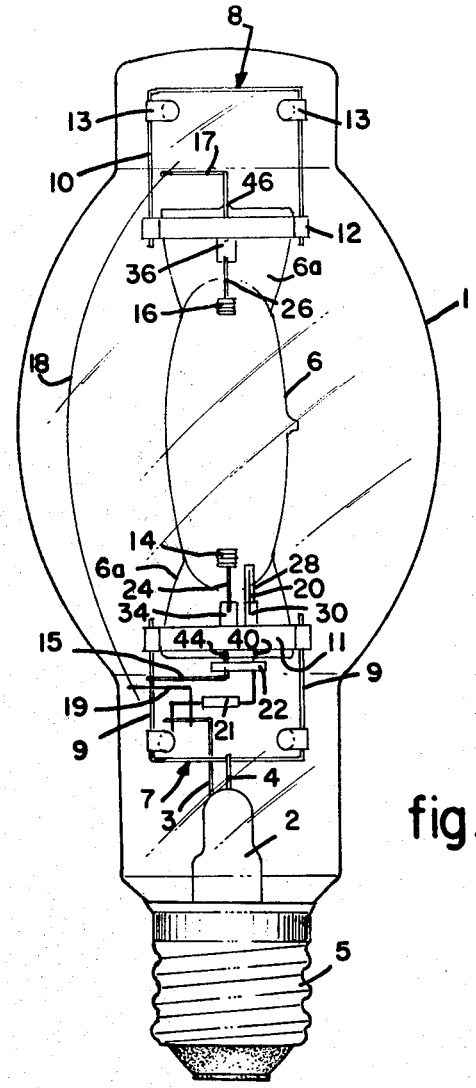
FIG. 1 is an elevational view of a high-pressure metal halide arc discharge lamp having a sleeved starting electrode according to the invention.

FIG. 1 illustrates the use of a "booted probe" according to the invention in a metal halide arc discharge lamp of the type having improved convection currents, such as described in the aforementioned U.S. Pat. Nos. 3,883,766 and 3,896,326. It is to be understood, however, that the "booted probe" is not limited to application in lamps of the specific type illustrated in FIG. 1, but has been found particularly useful and advantageous in limiting electrolysis in such lamps. The lamp includes an outer glass envelope or jacket 1, which is provided at one end with a sealed reentrant stem 2 through which extend relatively stiff lead-in wires 3 and 4 connected at their outer ends to the electrical contacts of the usual screw-type base 5. Centrally disposed within jacket 1 is an expanded section arc tube 6, which is made of quartz, a high fused silica glass.

Arc tube 6 is supported within jacket 1 by means of metal frames 7 and 8 at each end of the arc tube 6. Metal frames 7 and 8 comprise rigid wires 9 and 10, respectively, to which are fastened clamps 11 and 12 each of which supports a pressed-sealed end **6*a* of arc tube 6. Metal frame 7 is supported by lead-in wire 4 to which it is welded. Metal frame 8 is supported at the other end by metal leaf springs 13 which press against the inner wall of jacket 1. Sealed within the arc tube 6, at opposite ends thereof, are main discharge electrodes 14 and 16 which are supported on lead-in wires 24 and 26, respectively. Each main electrode comprises a core portion which may be a prolongation of wires 24 and 26 and may be prepared of a suitable electrode metal such as tungsten or molybdenum. The prolongation of wires 24 and 26** can be surrounded by tungsten or molybdenum or wire helixes.

An auxillary starting electrode (or probe) 20, generally prepared of tungsten, is provided at the lower end of arc tube 6 adjacent the main electrode 14 and comprises an inwardly projecting end of another lead-in wire. In accordance with the invention, as will be described in more detail hereinafter, a sleeve 28 of electrically insulating material is disposed about the starting electrode 20 for minimizing or preventing conduction between the main electrode 14 and the starting electrode 20 during normal lamp operation, thereby minimizing or preventing electrolysis.

The ends of the lead-in wires 24 and 26 are welded to molybdenum ribbon connectors 34 and 36, respectively, which are completely embedded within the press-seal ends **6*a* of the arc tube 6. The starting electrode 20 is connected to a molybdenum ribbon 30. Relatively short molybdenum terminal wires 44, 46 and 40 are welded, respectively, to the ends of the molybdenum ribbon connectors and serve to convey electrical current to the electrodes 14, 16 and 20**, respectively.

Electrical connection from lead-in wire 4 and metal frame 7 to the proximate terminal wire 44 associated with main electrode 14 is through connecting wire 15. Electrical connection from lead-in wire 3 to the terminal wire 46 associated with the other main electrode 16 is through wires 17, 18 and 19. Electrical connection from lead-in wire 3 to the terminal wire 40 associated with starting electrode 20 is through a current limiting resistor 21. A bimetal switch 22 is coupled between the terminal wires 44 and 40 to short the starting electrode to the adjacent main electrode 14 after lamp ignition occurs. Of course, such a bimetal switch may be omitted in view of our use of a "booted probe" to limit electrolysis in accordance with the invention; however, the bimetal switch may be included as a form of design redundancy to enhance reliability.

Arc tube 6 is provided with a filling of mercury which reaches pressures in the order of one-half to several atmospheres during normal lamp operation at temperatures of about 450° C. to 800° C. The filling also includes an ionizable gas, argon, for example, at an approximate fill pressure of 25 Torr. The filling also includes a halogen, except fluorine, and is preferably added in the form of an iodide of a suitable metal, such as sodium iodide; scandium iodide may also be included. In the specific embodiment illustrated in FIG. 1, the arc tube 6 has an expanded section at about or near its center in order to substantially eliminate radial convective flow between the upward flow and the downward flow, the result of this is a significant increase in lamp efficiency, as described in the aforementioned U.S. Pat. Nos. 3,883,766 and 3,896,326.

In accordance with the present invention, a sleeve 28 of electrically insulating material is disposed about the starting electrode 20 for minimizing or preventing conduction between the adjacent main electrode 14 and the starting electrode 20 during normal lamp operation, thereby minimizing or preventing electrolysis. Preferably, the sleeve, or boot, 28 is a tubular quartz sleeve which is melted into the press area *6a* of the quartz arc tube during the normal press sealing operation. As illustrated, the open end of the tubular sleeve 28 faces the interior of the arc tube, and the end of the substantially straight metal wire comprising the starting electrode 20 is recessed within the sleeve so that it does not protrude therefrom. We have found that, in order to limit electrolysis, it is important that the starting electrode not protrude from the insulating sleeve but be buried inside the sleeve except for the open end of the tubulation whereby the starting electrode is exposed to the interior atmosphere of the arc tube. In the preferred embodiment illustrated, we have found that a spacing A of about 0.5 millimeters between the end of the starting electrode 20 and the open end of the sleeve 28 provides the desired lamp starting function whle limiting electrolysis in accordance with the invention. The spacing A may range from 0 to 0.5 millimeters; however, a spacing A of greater than 0.5 millimeters may have an adverse effect on the starting function. In a typical specific implementation of this embodiment, starting electrode 20 had a diameter of 0.015 inch, and sleeve 28 was specified as 0.016 inch minimum ID and 0.040 inch OD with a minimum wall thickness of 0.005 inch.

Figure 2:
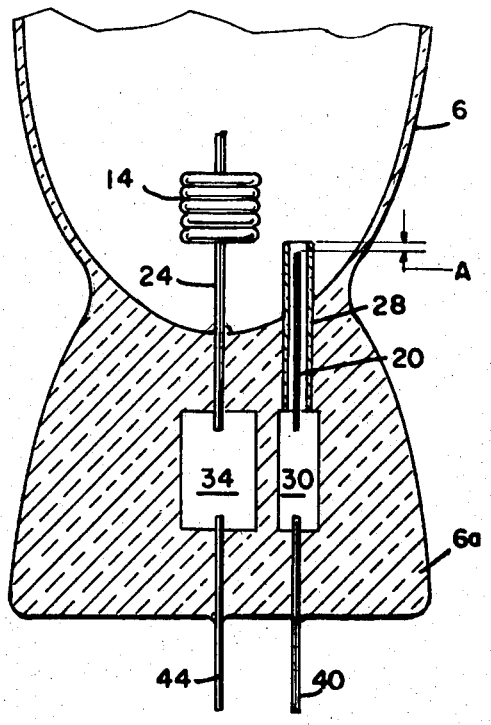
FIG. 2 is an enlarged fragmentary elevation, partly in section, of the end of the arc tube in the lamp of FIG. 1 which contains the starting electrode adjacent a main electrode.

Overheating of the quartz sleeve 28 could be a problem if it extends into the arc stream. Accordingly, the starting probe 20 and sleeve 28 are preferably much shorter than the adjacent main electrode 14, as illustrated in FIG. 2, so as to keep the sleeve temperature at a reduced level. For example, in one specific embodiment, the length of main electrode 14 (between foil 34 and the free end of electrode 14) is about 0.536 inch, whereas the length of probe 20 (between foil 30 and the free end of probe 20) is about 0.326 inch. Hence, the probe can be approximately in the order of one-half the length of the adjacent main electrode within the arc tube.

This "booted probe" configuration limits conduction between the main electrode 14 and the starting electrode 20 so that there is substantially no conduction on either half cycle when the lamp is operating and no DC potential. As a result there is no sodium migration between these electrodes, with ensuing electrolysis. That is, we have found that if no arc occurs between the starter and main electrode during normal lamp operation, then no DC potential exists between these electrodes and therefore electrolysis is essentially eliminated. To prevent such arcing between the starter and adjacent main electrode during normal lamp operation, therefore, it is important that in no case can the starting probe extend from the quartz sleeve.

We have found this technique to be successful in all types of standard metal halide arc discharge lamps, and have found it particularly useful in the improved convection type metal halide lamps, such as that illustrated in FIG. 1 and described above. It has no temperature requirements that the arc tube does not already have and is thus a distinct improvement over the diode approach of the aforementioned U.S. Pat. No. 3,619,711. Further, because tight tolerances can be held on the starter electrode assembly and quartz sleeve cutting, manufacturing difficulties are minimized. The use of the quartz sleeve also eliminates the possibility of the mercury fill from shorting the starter and main electrode when they are in the down position, thus allowing the arc tube to be used in any burning configuration and, thus, providing a universal metal halide lamp.

Figure 3A:
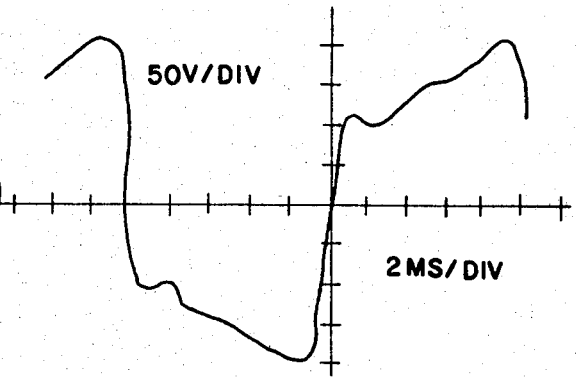
FIG. 3A is a waveform diagram of the voltage between the main and starter electrodes in a lamp having a sleeved starting electrode according to the invention.
Figure 3B:
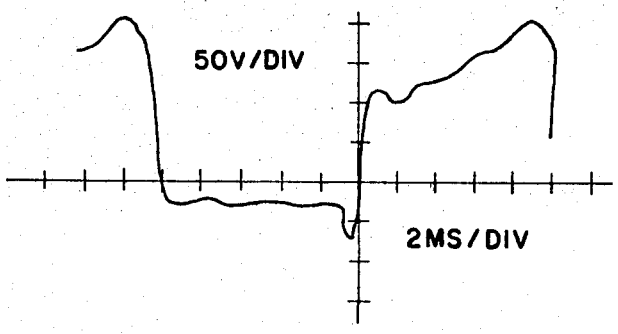
FIG. 3B is a waveform diagram of the voltage between the main and starting electrodes of a prior art lamp containing a starting electrode without a sleeve.

FIG. 3A is a waveform diagram of the voltage between the main electrode 14 and starting electrode 20, in which the starting electrode is recessed within an insulating sleeve 28 in accordance with the invention; it will be noted that a very symmetrical wave shape is obtained with the "booted probe" and there is an absence of DC potential. FIG. 3B is a waveform diagram of the voltage between the main electrode and a conventional unsleeved starting electrode; it shows the assymmetrical wave shape that is typically obtained and which leads to electrolysis.

Although the invention has been described with respect to a specific embodiment, it will be appreciated that modifications and changes may be made by those skilled in the art without departing from the true spirit and scope of the invention.

We claim:

1. An arc discharge lamp comprising:

an arc tube containing an ionizable discharge-sustaining fill including mercury and a metal halide;

first and second main electrodes disposed within the arc tube;

a starting electrode disposed within the arc tube adjacent the first main electrode; and a sleeve of electrically insulating material disposed about said starting electrode with said starting electrode recessed within said insulating sleeve, the lengths of said sleeve and said starting electrode being substantially shorter than but not less than about one-half the length of said first main electrode within said arc tube, said sleeve having an open end whereby said starting electrode is exposed to the internal atmosphere of said arc tube, and said starting electrode not projecting beyond the open end of said sleeve; whereby conduction between said first main electrode and said starting electrode is minimized or prevented during normal lamp operation, thereby minimizing or preventing electrolysis.

2. The lamp of claim 1 wherein said arc tube is formed of an alkaline-containing material.

3. The lamp of claim 1 wherein said arc tube contains an alkaline earth additive.

4. The lamp of claim 1 wherein said insulating sleeve is tubular with an open end facing the interior of said arc tube, and said starting electrode comprises a substantially straight metal wire having an end recessed within said sleeve and spaced in the range of 0 to 0.5 millimeters from said open end of the sleeve.

5. The lamp of claim 4 wherein said insulating sleeve and said arc tube are formed of quartz.

6. The lamp of claim 5 wherein said arc tube has a press seal at each end, said first and second main electrodes are disposed at each end of the arc tube, and said quartz sleeve is melted into the press seal at the end of said arc tube at which said first main electrode is disposed.

* * * * *